United States Patent [19]

Deutsch

[11] 4,194,427

[45] Mar. 25, 1980

[54] GENERATION OF NOISE-LIKE TONES IN AN ELECTRONIC MUSICAL INSTRUMENT

[75] Inventor: Ralph Deutsch, Sherman Oaks, Calif.

[73] Assignee: Kawai Musical Instrument Mfg. Co. Ltd., Hamamatsu, Japan

[21] Appl. No.: 890,249

[22] Filed: Mar. 27, 1978

[51] Int. Cl.[2] ..... G10H 1/02

[52] U.S. Cl. ..... 84/1.24; 84/1.03; 364/717

[58] Field of Search ..... 84/1.01, 1.03, 1.24; 364/717, 721; 331/78

[56] References Cited

U.S. PATENT DOCUMENTS

| | | | |
|---|---|---|---|
| 3,247,308 | 4/1966 | Peterson | 84/1.24 |
| 3,548,174 | 12/1970 | Knuth | 364/717 |
| 3,740,450 | 6/1973 | Deutsch | 84/1.24 |
| 4,022,098 | 5/1977 | Deutsch | 84/1.03 |
| 4,038,898 | 8/1977 | Kniepkamp | 84/1.24 |
| 4,085,644 | 4/1978 | Deutsch et al. | 84/1.01 |

*Primary Examiner*—J. V. Truhe
*Assistant Examiner*—William L. Feeney
*Attorney, Agent, or Firm*—Christie, Parker & Hale

[57] ABSTRACT

An electronic tone synthesizer in which a master data list of digital values representing the amplitudes of points defining the waveform of a musical tone are transferred to a digital-to-analog converter at a rate proportional to the pitch of the tone being generated. Noise is superimposed on the musical tone by means of a random binary signal generator which controls a circuit for modifying selected ones of the digital values as they are transferred from the master data list to the converter. Modification of the selected values may be by a right shift operation, a 2's complement operation, or by selective delay.

8 Claims, 8 Drawing Figures

GENERATION OF NOISE-LIKE TONES IN AN ELECTRONIC MUSICAL INSTRUMENT

FIELD OF THE INVENTION

This invention relates to musical tone synthesizers, and more particularly, to a noise generator for a digital tone generator.

BACKGROUND OF THE INVENTION

The generation of musical tones electronically, either by analog or digital circuits, is well known. In attempting to duplicate the sounds of conventional musical instruments it may be desirable to superimpose sounds which can only be characterized as "noise" onto the musical tones. Such added noise may be introduced to simulate the air noise, hiss, or breathiness characteristic of wind-operated instruments, such as the organ pipes of a conventional organ, or other types of wind instruments. In prior art digital type organs tones have been created imitative to noisy wind-blown organ pipes, by using a frequency modulation technique. This has been accomplished by adding or subtracting a fixed constant to the frequency number used to address the tone data. Alternatively, the noise has been added to the reference voltage of the analog output signal from the digital-to-analog converter to produce an amplitude modulated noise. Noiselike tones have been created in digital tone generators by the type which calculate musical waveshapes by computation with an algorithm that uses sets of harmonic coefficients. However, the resulting tonal effect is not easily controlled. If the harmonic coefficients are varied in a random fashion, noise having a very wide spectrum is produced and has the effect of substantially obliterating the basic musical tone being generated.

SUMMARY OF THE INVENTION

In copending application Ser. No. 603,776, filed Aug. 11, 1975, entitled "Polyphonic Tone Synthesizer", now issued as U.S. Pat. No. 4,085,644 there is described a digital tone generator in which a master data list is calculated and stored in a main register. The master data list consists of a series of digital values representing the amplitudes of a corresponding series of points defining the waveform of one cycle (or fraction of a cycle) of a musical tone. The master data list is transferred from the main register to a Note shift register and from the Note register to a digital-to-analog converter at a rate determined by the pitch or fundamental frequency of the tone being generated. Because the pitch is controlled independently of the amplitude values in the master data list, any set of numbers stored in the Note shift register will produce a musical tone having a controlled fundamental frequency determined by the rate at which the data is shifted out of the Note register. Thus, regardless of what is done to the numbers in the Note shift register, a musical tone is generated which has no noise-like sound, since the fundamental frequency is always present. To produce a noise-like tone in such a system, it is necessary that the numbers stored in the Note shift register be varied with time in a random fashion. The present invention provides an arrangement for varying the master data set as a function of time in order to obtain tone variant data in the Note shift register. This is accomplished, in brief, by providing a random number generator means, such as a right shift, 2's complement, or other circuit, for modifying digital words in the master data list, and logic means responsive to the random number generator for activating said modifying means at random times so as to modify selected ones of the digital words in the master data list before they are transferred to the digital-to-analog converter.

DESCRIPTION OF THE DRAWINGS

For a more complete understanding of the invention reference should be made to the accompanying drawings, wherein.

DETAILED DESCRIPTION

Figure 1:
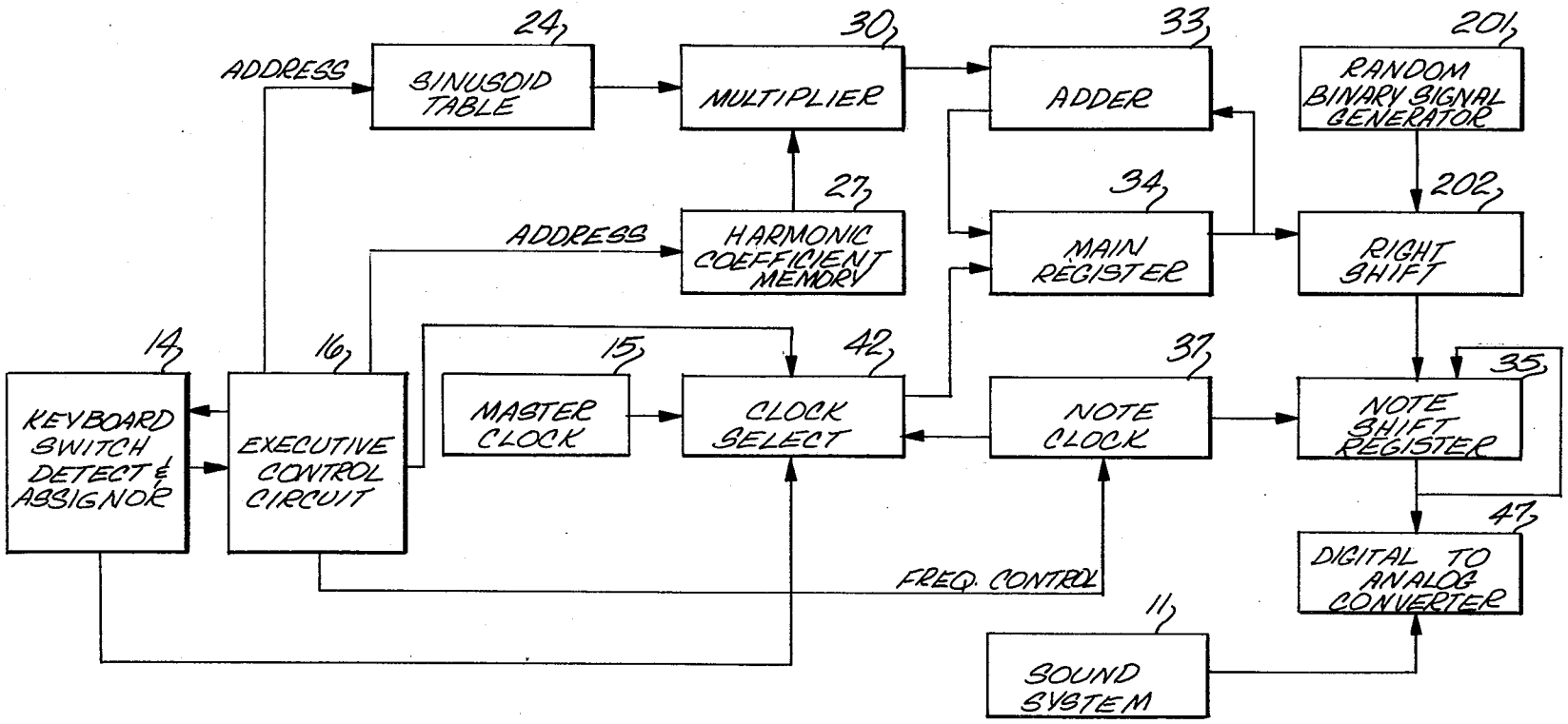
FIG. 1 is a schematic block diagram of one embodiment of the present invention.

The preferred embodiment of the present invention is described as an improvement to a polyphonic tone synthesizer of the type described in the above-identified Patent No. 4,085,644, and hereby incorporated by reference. The polyphonic tone synthesizer includes a keyboard switch detect and assignor circuit 14 which, in response to operation of one or more keys on a standard musical keyboard stores information as to the particular key that is actuated, and assigns one of a plurality of tone generators to that key, as described in detail in U.S. Pat. No. 4,022,098. When a key is detected and assigned, an executive control circuit 16 initiates a computation cycle for computing a master data list which corresponds to the amplitude of a series of points defining one cycle (or half a cycle) of the waveform of the tone to be generated. The computation involves the summation of the amplitude of all the harmonics which, by Fourier analysis, combine to define the waveform. The amplitude values of the points along the waveform of each harmonic are calculated by multiplying a series of sinusoid values from a sinusoid table 24 by selected harmonic coefficients in a harmonic coefficient memory 27 by means of a multiplier 39. The amplitude values corresponding to 64 points per cycle (or 32 points for a half cycle) are calculated and stored in a main register 34. The process is repeated for each higher order harmonic, the amplitude values for each successive harmonic being added to the values in the main register 34 by means of an adder 33. The Executive Control 16 includes a word counter and harmonic counter for addressing the sinusoid table 24 and harmonic coefficient memory 27 in the manner described in detail in the above-identified application.

At the end of the computation cycle, a master data list is stored in the main register 34 consisting of 64 words corresponding to the amplitudes of 64 equally spaced data points defining one cycle of the waveform to be generated. The computation operation takes place at a relatively high clock speed controlled by a master clock 15. The master clock pulses are applied to the main register 34 through a clock select circuit 42 during the computation operation, so as to synchronize the shifting of the main register 34 with the addressing of the sinusoid table 24 of the harmonic coefficient memory 27 and operation of the multiplier 30 and adder 33.

At the end of the computation cycle, the clock select circuit 42, under operation of the executive control 16, selects pulses from a Note clock source 37. The Note clock source 37 is a voltage controlled oscillator which is part of the assigned tone generator and has a frequency which is exactly 64 times the pitch or fundamental frequency of the note selected by operation of a key on the keyboard. Clock pulses from the Note clock 37 are also applied to a Note shift register 35 which is also part of the assigned tone generator. At the end of the computation cycle, the master data list in the main register 34 is shifted to the Note shift register 35 at a rate determined by the clock pulses from the Note clock 37. Once the master data list is transferred to the Note shift register 35, the executive control 16 can initiate a new computation cycle for loading a new master data list in the main register 34. At the end of the computation cycle, the new master data list may be transferred either to the Note shift register 35 of the same tone generator, or may be transferred to the Note shift register of another tone generator (not shown), depending upon whether one or more keys have been depressed on the keyboard.

Once the master data list defining the waveshape of the tone to be generated is loaded into the Note shift register 35, the master data list is transferred one word at a time to a digital-to-analog converter 47. At the same time the words in the master data list are recirculated in the Note register 35. Each word in the master data list is converted to a corresponding analog voltage at the output of the converter 47. Thus successive words are converted to a voltage at the output of the converter which corresponds to the desired waveshape of the tone to be generated. The analog voltage at the output of the converter is applied to a sound system 11 for converting the analog voltage to a corresponding sound. The fundamental frequency of the analog signal is determined by the frequency of the Note clock 37. Merely by changing the frequency of the Note clock 37, the same tone having the identical waveshape but a different fundamental frequency, can be produced. It will be seen that regardless of what the amplitude values represented by the words in the master data list may be, as long as these words are transferred to the digital-to-analog converter at a controlled frequency, a sound will be generated by the sound system 11 having the same pitch. The only effect of changing the relative amplitudes of the data points is to change the tone quality of the sound. Since the ear will always hear the fundamental frequency, the output will always have a musical quality and will not sound like random noise.

According to the present invention, noise can be superimposed on the generated sound by modifying selected words of the master data list as a function of time, the words being selected for modification in a random manner. This is accomplished in the circuit arrangement of FIG. 1 by providing a random binary signal generator 201. The generator 201 generates a series of binary coded signals having the binary values 0 or 1. The output of the random binary signal generator 201 is applied to a Right Shift circuit 202 which receives the words of the master data list read out of the main register 34. The Right Shift circuit 202 operates to shift the binary bits of each word one place to the right, thus changing the most significant bit from a 1 to a 0, and changing all the lower order bits to the value of the next higher order bit of the word received from the main register 34. Right Shift circuits of this type are well known in the digital computer art.

Figure 2:
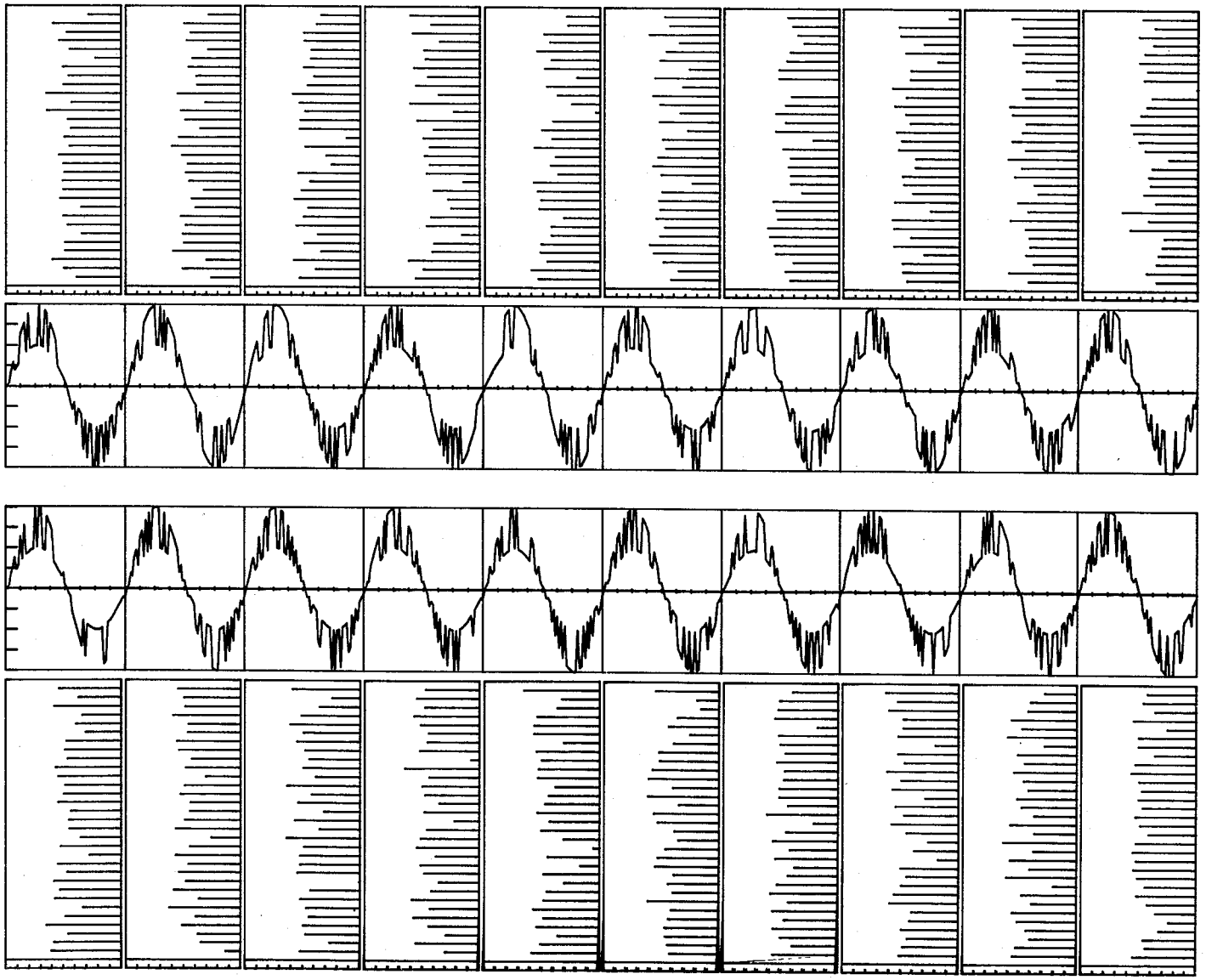
FIG. 2 is a waveform and spectrum of a random right shift of a master data list defining a sinusoid signal.

The Right Shift circuit 202 is activated in response to one of the two binary values from the random binary signal generator 201, for example, a binary 1. If the other binary value, for example, binary 0, is received from the generator 201, the Right Shift register 202 does not do a right shift but transfers the word unmodified from the main register 34 to the Note shift register 35. By this arrangement words selected in the master data list at random are modified by a right shift as they are loaded into the Note shift register 35. Following subsequent computation cycles, the master data list is again transferred to the Note shift register 35 from the main register 34 through the Right shift circuit 202, but because of the random character of the generator 201 different words in the list will be selected for modification each time this transfer is made. Thus the words stored in the Note shift register 35 are continuously being modified in a randomly selected manner before being transferred to the digital-to-analog converter 47. The resulting audio tone, while still retaining the fundamental frequency as fixed by the Note clock 37, varies in upper harmonic content in a random manner which is heard as a noise superimposed on the basic tone. It should be noted that the master data list in the main register 34 may initially define any conventional waveshape, such as a simple sine wave, a sawtooth wave, or a complex tone. FIG. 2 shows a plot of the waveform, assuming a sinusoidal waveform stored in the main register 34 is modified by the right shift of words selected on a random basis. The noise-like signal is easily recognized in the plotted waveshapes. The spectrum of each cycle of the waveshape is shown. In each case the fundamental is retained as the strongest component, establishing the musical pitch, while the higher order components change in relative power to provide the desired noise-like effect.

Figure 3:
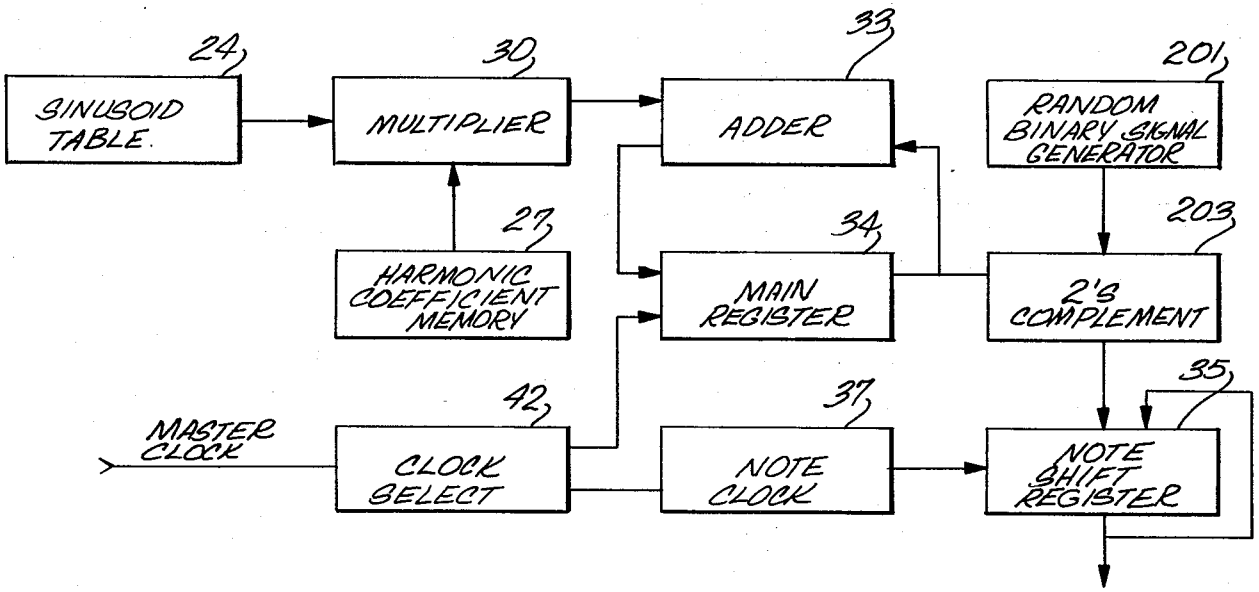
FIG. 3 is a schematic block diagram of an alternative embodiment of the present invention.

Referring to the block diagram of FIG. 3, an alternative embodiment is disclosed which is substantially the same as that shown in FIG. 1, except that a 2's complement circuit 203 is substituted for the Right Shift circuit of FIG. 1. Thus words being transferred from the main register 34 to the Note shift register 35 are modified to the 2's complement of the word at random times as determined by the random binary signal generator 202. It should be noted that the frequency at which the random binary signal generator 201 operates need not be the same as the frequency of the Note clock 37, although it may be synchronized with the Note clock 37 if desired.

Figure 4:
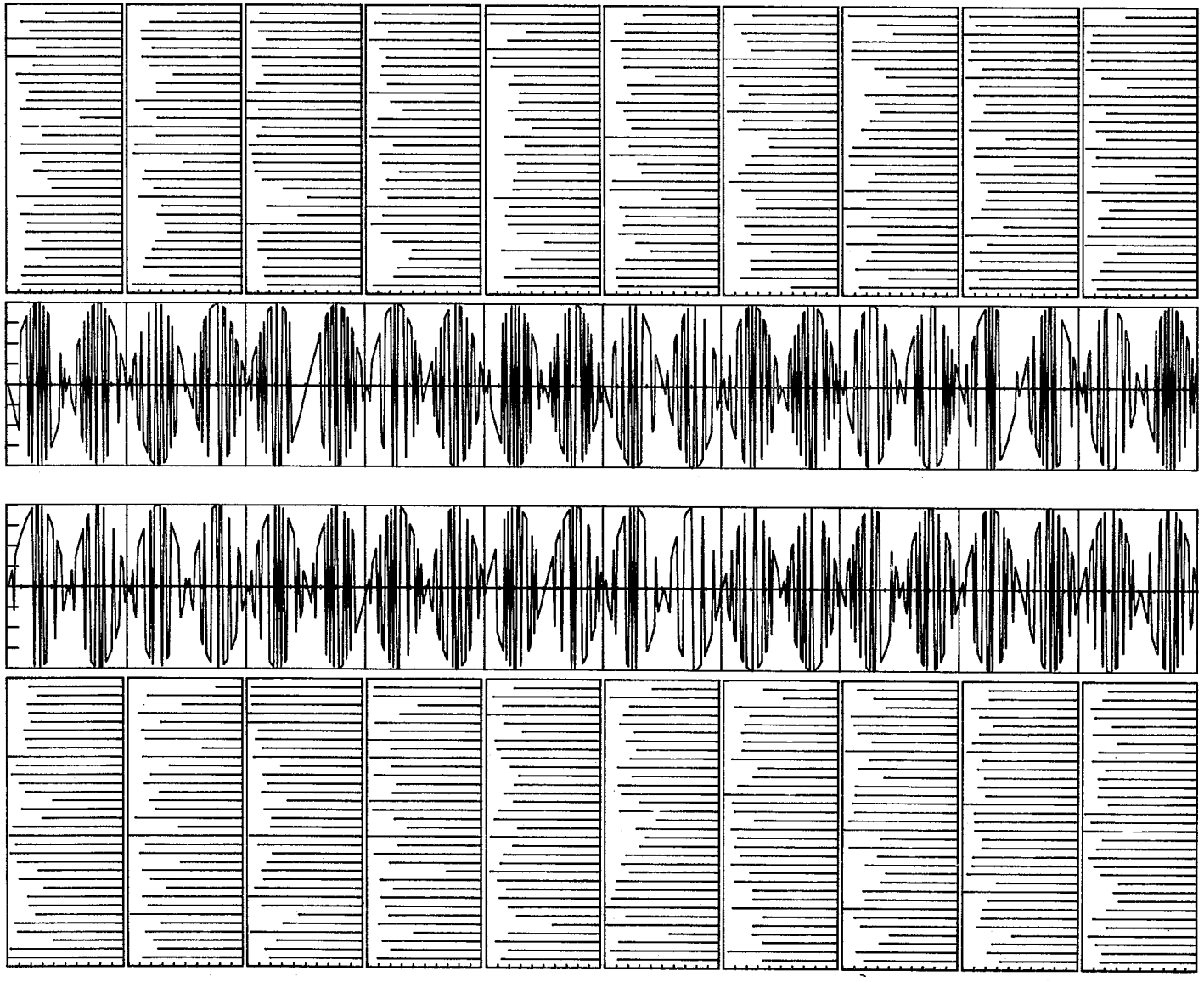
FIG. 4 is a waveform and spectrum of a random 2's complement of selected words in a master data list defining a sinusoid signal.

FIG. 4 shows twenty successive data transfers and their associated spectra for the circuit of FIG. 3. The master data list in the main register 34 corresponds to a simple sinusoid at the fundamental frequency. As can be seen from the waveforms of FIG. 4, the random 2's complement data transfer creates tones having a wide band noise-like spectra.

Figure 5:
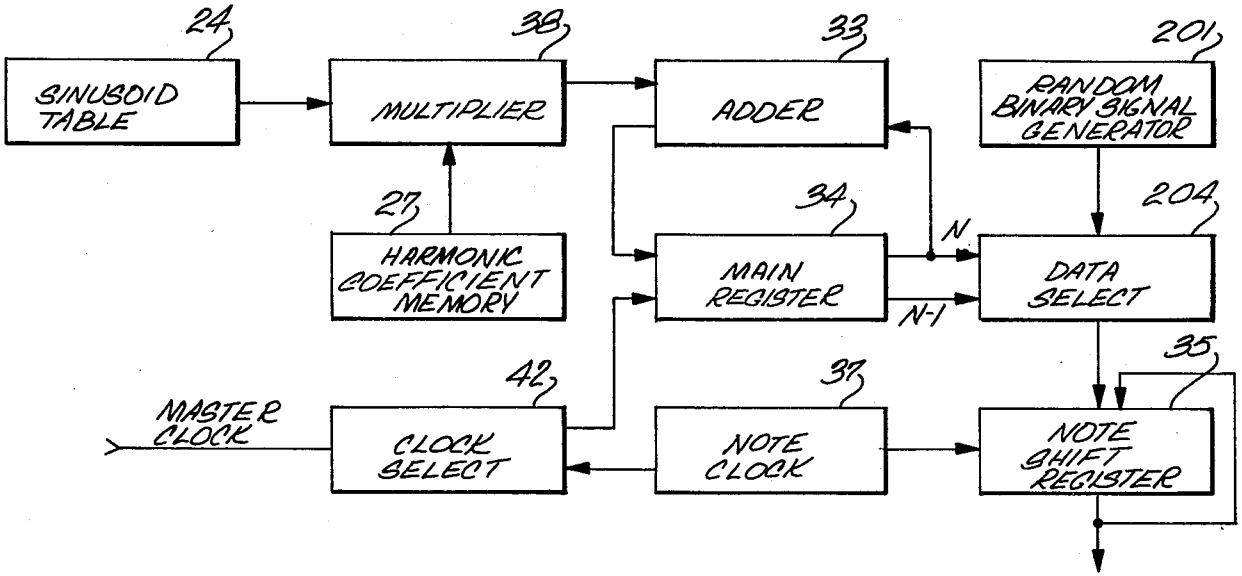
FIG. 5 is a schematic block diagram of yet another embodiment of the present invention.

Referring to FIG. 5, there is shown yet another alternative embodiment in which the random binary signal generator 201 is used to select either of two words from the master data list from the main register 34 on a random basis. The data select circuit 204 operates to select either the present data on the output of the main register 34 or the following data point, which normally would be shifted out of the main register with the next following note clock pulse. The two outputs are taken from the two right-hand word storage positions in the shift register 34 so that the data points for word N and N-1 are simultaneously presented to the data select circuit 204. In response to signals provided by the random binary signal generator 201, the data select circuit causes either the current word at N or the next following word at N-1 in the main register 34 to be transferred to the Note shift register 35 at a given clock time. The result may be considered as a type of phase modulation.

Figure 6:
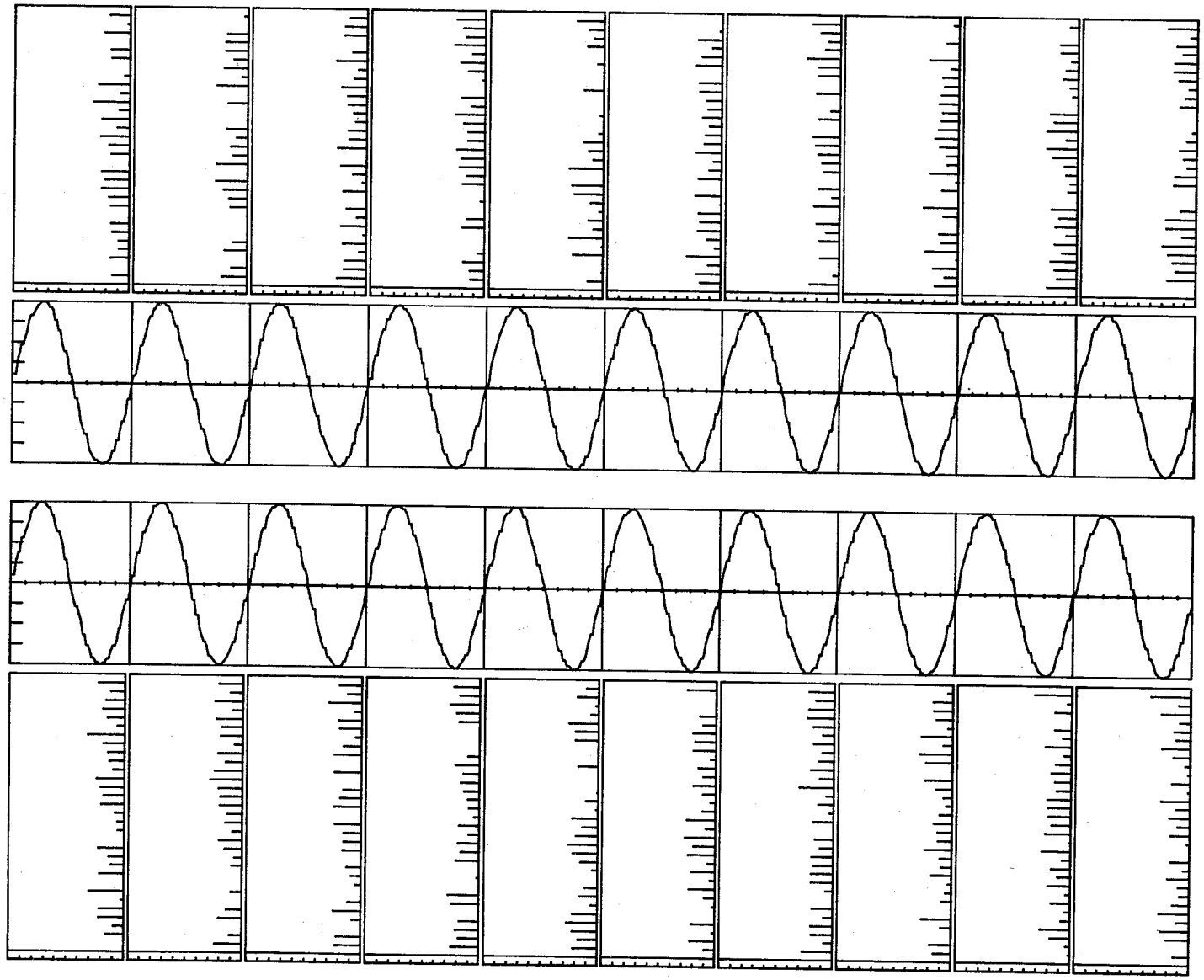
FIG. 6 is a waveform and spectrum plot of the random modification of a sinusoid signal by the circuit of FIG. 5.

FIG. 6 illustrates twenty waveshapes and their associated spectra generated by the system shown in FIG. 5. The data residing in the main register 34 corresponds to a simple sinusoid at the fundamental frequency. It is apparent that a noise-like background is produced without any marked change in the original signal. The audible effect is to produce a hissing sound superimposed on the basic tone, thus simulating to a considerable degree the characteristics of an organ pipe or the like.

While the arrangement shown in FIGS. 1, 3, and 5 each show the modification of the selected words taking place during the transfer between the main register 34 and the Note shift register 35, it will be understood that the modification can be made in the recirculation loop of either the main register 34 or the Note shift register 35.

Each of the above described arrangements introduce noise by modifying words in the master data list on a randomly selected basis with time. While three examples are given of ways that the selected words are modified, the invention is not limited to these specific examples. It is evident from the waveform diagrams that the degree of modification of the selected words determines the amount of noise distortion introduced in the waveform. Also the frequency of the random binary signal generator 201 will effect the extent of the noise distortion introduced by the invention, since this determines the number of words in the master data list which are selected for modification.

Figure 7:
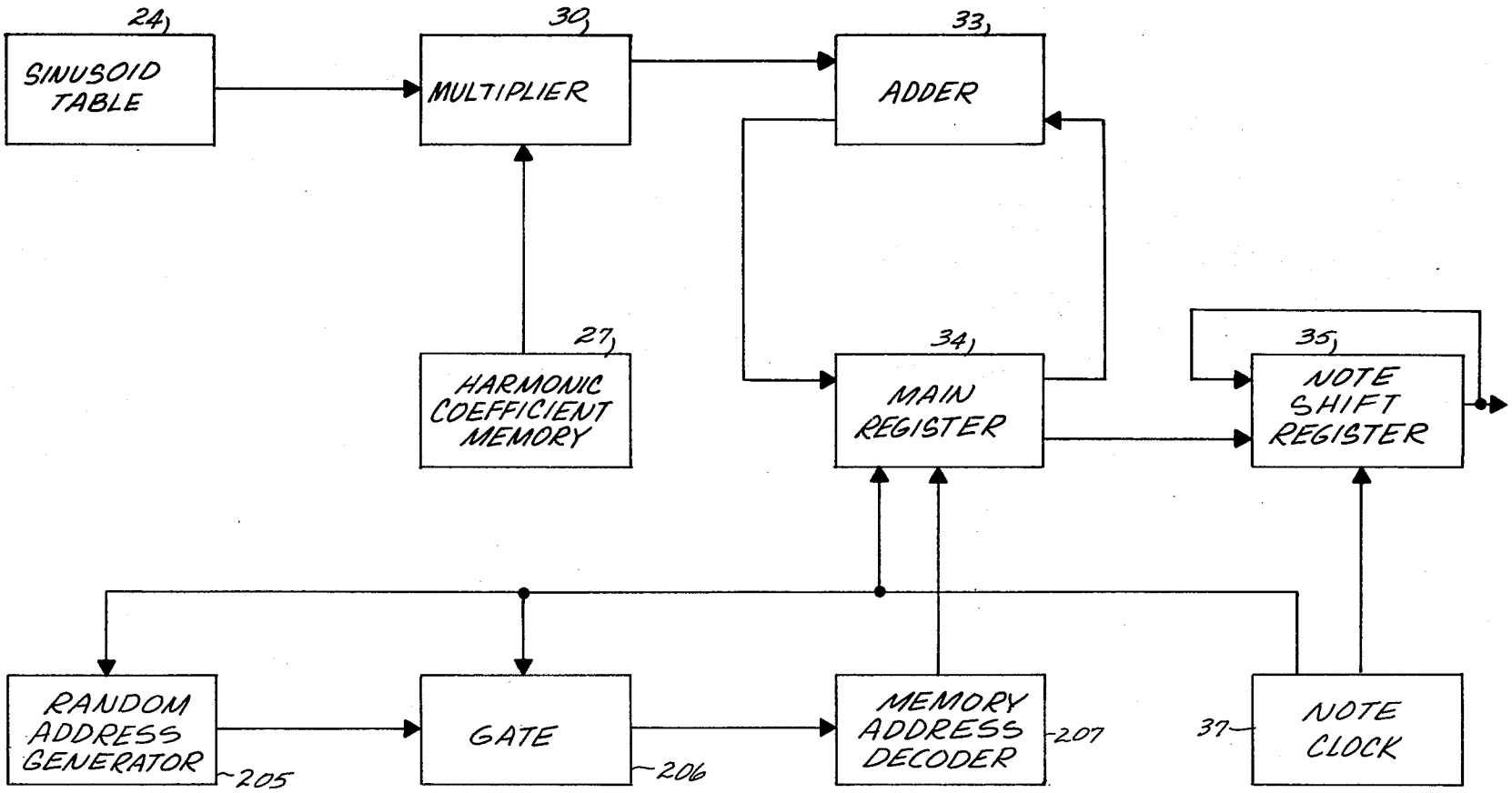
FIG. 7 is a schematic block diagram of yet another embodiment of the present invention.
Figure 8:
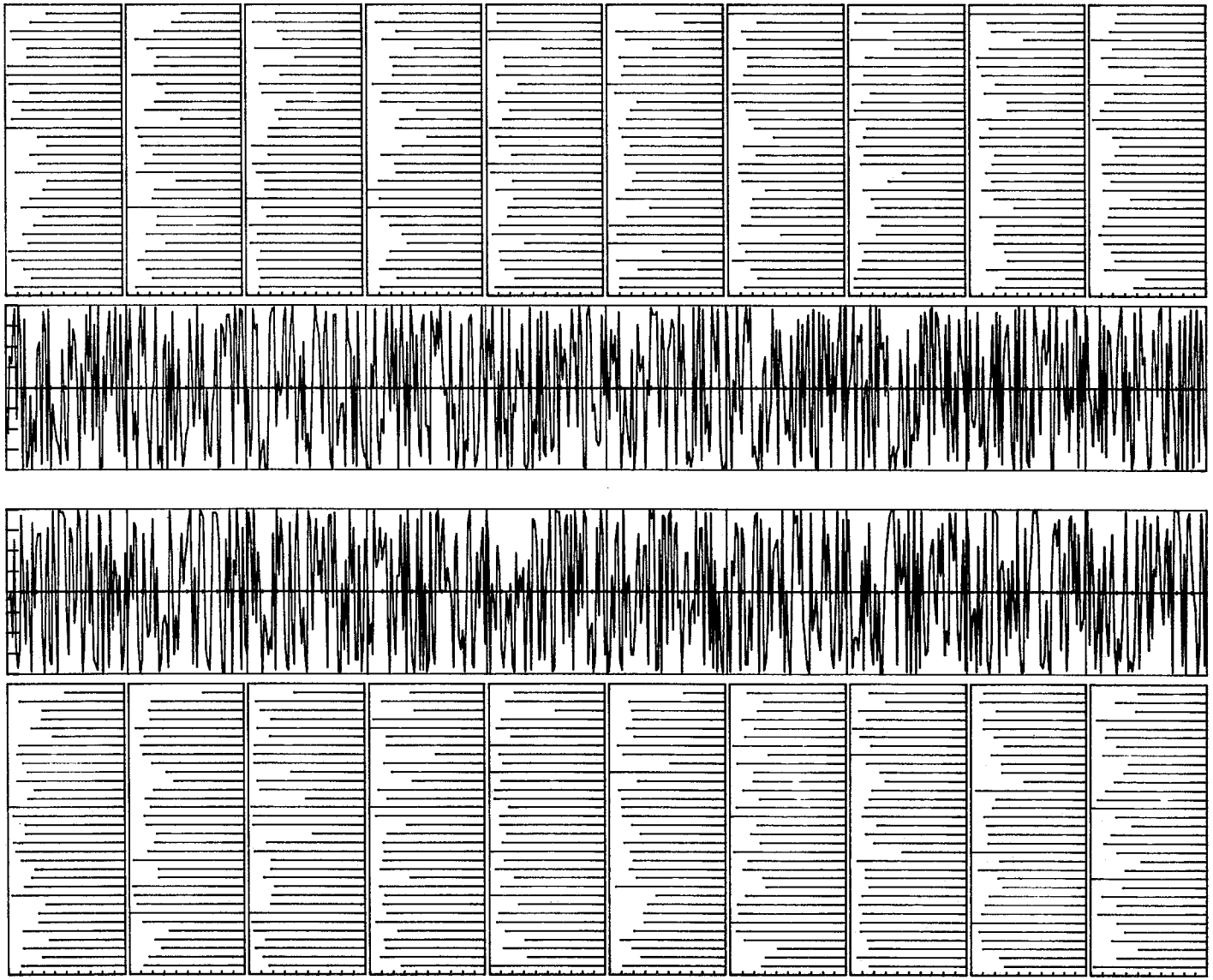
FIG. 8 is a waveform and spectrum plot of a sinusoid signal modified in the manner of FIG. 7.

The arrangement of FIG. 5 can be expanded to provide substitution of other words in the master data list rather than the next adjacent word. An expansion on this concept is shown in FIG. 7 which shows an arrangement by which any word in the master data list may be substituted for another data word at the time of transfer to the Note shift register on a random basis. This is accomplished by having all the word-storing locations in the main register 34 individually addressable. Thus during the transfer phase of operation the main register 34 is operated as a random access memory rather than a shift register. A random address generator 205 generates addresses in synchronism with the note clock 37, each address being gated by a gate 206 to a memory address decoder 207, the output of which addresses a word in the master data list stored in the main register 34. Thus at any given note clock time during the transfer operation any of the data words comprising the master data list in the main register 34 may be addressed and transferred to the input to the Note shift register 35. FIG. 8 shows twenty data transfers and their corresponding spectra for the system shown in FIG. 7. The data residing in the main register 34 corresponds to a simple sinusoid at the fundamental frequency. It is apparent that wide-band noise-like signals have been created from the original sinusoid data set. It should be noted that in each of the above-described arrangements, by using a simple sinusoid for the master data list, the calculation of the master data list is greatly simplified, resulting in a substantial saving of calculation time for the master data list. This gain in the speed of calculation time is advantageous in introducing time varying effects.

What is claimed is:

1. An electronic tone synthesizer for generating an audio signal having a predetermined waveform in which noise is superimposed on the audio signal, comprising: a group of digital words representing the relative amplitudes of equally spaced points defining the waveform of an audio signal, a digital-to-analog converter, means transferring the digital words sequentially from the generating means and applying the words in repetitive sequence to the converter, the transferring means including means for modifying the digital value of any selected word as it is being transferred, a random signal generator for generating an output signal at random time intervals, and means responsive to the random output signal for momentarily activating said means for modifying a word being transferred, whereby the digital words are modified at random during transfer.

2. Apparatus of claim 1 wherein said means for modifying said digital values includes a right shift circuit for shifting the digital values of the randomly selected words numerically at least one place to the right.

3. Apparatus of claim 1 wherein said means for modifying said digital values includes a 2's complement circuit for generating the 2's complement of the digital values of the randomly selected words.

4. Apparatus of claim 1 wherein said means for modifying said digital values includes means for delaying the time of transfer at which a selected word is transferred from the generating means.

5. Apparatus of claim 2 wherein the transferring means further includes a shift register, a right shift circuit for transferring each of the digital words in sequence from the generating means to the shift register, clock means for generating clock signals at a rate proportional to the pitch frequency of the tone being generated, said transferring means being activated by said clock signals.

6. Apparatus of claim 3 wherein the transferring means includes a shift register, a 2's complement circuit for transferring each of the digital words from the generating means to the shift register, clock means for generating clock signals at a rate proportional to the pitch frequency of the tone being generated, said transferring means being activated by said clock signals.

7. In an electronic tone synthesizer in which a master data list of digital values representing the amplitude of points defining the waveform of a musical tone are transferred to a digital-to-analog converter at a rate proportional to the pitch of the tone being generated, apparatus for superimposing noise on the tone comprising: an addressable memory for storing the master data list, a shift register receiving the output of the memory, clock means for generating clock pulses at said rate proportional to the pitch of the tone being generated, the clock means shifting said register, random address generating means for selectively transferring words from any one of a plurality of locations in the master data list memory to the shift register with each clock pulse, and means transferring the words in the shift register to said converter to convert said words to an analog voltage whose amplitude is controlled by the digital values of said words stored in the shift register.

8. A tone synthesizer comprising source means providing a group of words representing respectively the amplitudes of equally spaced points defining the waveform of a musical tone, digital-to-analog converter, means transferring said group of words in timed sequence from the source means and applying the words to the converter, and a random signal generator for generating timing pulses at random time intervals, said transferring means including means responsive to the timing pulses from said random signal generator for modifying the values of those digital words transferred in time coincidence with the pulses from the random signal generator.

* * * * *